United States Patent [19]

Stockton

[11] 4,357,885

[45] Nov. 9, 1982

[54] FABRIC HOLDING DEVICE FOR MULTI-HEAD EMBROIDERY MACHINES

[75] Inventor: Allen L. Stockton, Burlington, N.C.

[73] Assignee: Liberty Embroidery, Inc., Burlington, N.C.

[21] Appl. No.: 292,094

[22] Filed: Aug. 12, 1981

[51] Int. Cl.[3] ..... D05C 9/04

[52] U.S. Cl. ..... 112/103; 112/155

[58] Field of Search ..... 112/103, 102, 98, 121.12, 112/121.15, 155

[56] References Cited

U.S. PATENT DOCUMENTS

| | | | |
|---|---|---|---|
| 994,033 | 5/1911 | Richter | 112/103 |
| 2,091,727 | 8/1937 | Bohmann et al. | 112/102 |
| 3,664,288 | 5/1972 | Von Beden et al. | 112/103 |

FOREIGN PATENT DOCUMENTS

| | | | |
|---|---|---|---|
| 404825 | 10/1909 | France | 112/103 |
| 2430471 | 3/1980 | France | 112/103 |

*Primary Examiner*—H. Hampton Hunter

*Attorney, Agent, or Firm*—Charles R. Rhodes; Judith G. Smith

[57] ABSTRACT

Small fabric pieces to be embroidered are secured to the undersurface of an adapter member by tape strips or the like. The adapter member is then received in a female receiving seat in a fixture or frame secured to the conventional machine frame displacing device which presents the fabric pieces to one of the embroidery heads of a multi-head embroidery machine according to a prescribed pattern.

6 Claims, 5 Drawing Figures

FABRIC HOLDING DEVICE FOR MULTI-HEAD EMBROIDERY MACHINES

BACKGROUND AND SUMMARY OF THE INVENTION

The present invention pertains to the production of small embroidery pieces such as patch pockets and the like on muti-head embroidery machines. Such machines, as illustrated in the U.S. Pat. No. 2,091,727 to Bohmann et al, include a plurality of embroidery heads arranged on some type of common support mechanism. Each head includes an embroidery frame associated therewith, and all of the embroidery frames are generally mechanically interconnected to a frame displacing or control device which moves all of the individual frames according to a desired pattern beneath the corresponding heads to accomplish embroidery patterns simultaneously on multiple pieces of fabric, each of which is positioned beneath one of the heads. This, of course, is a high production arrangement.

Each embroidery frame in a typical multi-head installation includes a pair of hoops (inner and outer). Fabric is held in place between the inner and outer hoops while the embroidering occurs. Obviously, the fabric being held must be of a size at least as large as the puter dimensions of the inner hoop so that it extends into the interface between the two hoops for holding purposes.

Therefore, in the past, the embroidering of small fabric pieces such as pockets has been a problem in that pockets are not of a size generally large enough to be held within the inner and outer hoops. One known way to overcome this problem is by means of performing the embroidery on relatively large pieces of fabric, then cutting the pieces of fabric into the proper small size. However, it can be easily seen that such a technique is extremely wasteful as far as the fabric is concerned, in that a relatively large piece of fabric is necessary merely to hold the fabric in place for the embroidery operation.

One known alternative to this approach is described as the "Hong Kong" method in which the embroidery machine is provided with a single frame plate having a plurality of small apertures therein, each aperture being positioned below one of the embroidery heads, and manipulated all at once by the frame displacing device. This way the small fabric pieces can be attached to the frame and embroidered after they are cut to prevent the waste of material. On the other hand, while fabric waste may be eliminated, production economics cannot be realized because once the embroidery operation is completed, the machine is shut down until all of the fabric pieces can be removed from the adapted plate and new fabric pieces attached thereon. This considerably hampers the speed of the embroidery operation.

Another alternative is shown and described in the U.S. Pat. No. 3,664,288 to von Boden et al. In this approach, a specially designed frame at each head includes means for temporarily holding smaller fabric pieces thereto than could be attached to conventional hoops. While fabric waste is eliminated, there is still the problem that at the end of the embroidery operation, one set of completed fabric pieces must be removed from the frame beneath each head and new fabric pieces properly positioned thereunder, which is relatively time consuming.

In the present invention, however, small cut pieces may be embroidered while achieving production economics. A flat adapter plate is secured to the undersurface of a male ring member, which plate has a clearance aperture therein for passage of the embroidery needle to the fabric. The small fabric pieces are then merely taped or secured by some similar device to the rear or undersurface thereof. The male member is then merely laid into a female receiving opening in a board or fixture which is attached to the machine frame displacing device and the fabric pieces are thus presented to the embroidery head. In such an arrangement, while the embroidery operation is commencing with one set of male rings in the fixture, a second set of inner hoops is having a new set of fabric pieces attached thereto. At the end of the embroidery operation, the operator merely removes one set of inner hoops and lays in a second set of inner male rings to which the fabric pieces have already been attached. Thus, the down time of the machine is kept to a minimum, so that production can be significantly enhanced.

In the preferred embodiments, the undersurface of the adapter plate is preferably formed from a teflon material so that should a needle inadvertently engage the plate no damage will occur.

It is therefore an object of the present invention to provide an improved fabric holding device for positioning small fabric pieces on multi-head embroidery machines.

It is another object of the present invention to provide a fabric securing device which minimizes the down time of the embroidery machine between successive embroidery operations.

Other objects and a fuller understanding of the invention will become apparent from reading the following description of a preferred embodiment along with the accompanying drawings in which.

DETAILED DESCRIPTION OF A PREFERRED EMBODIMENT

Figure 1:
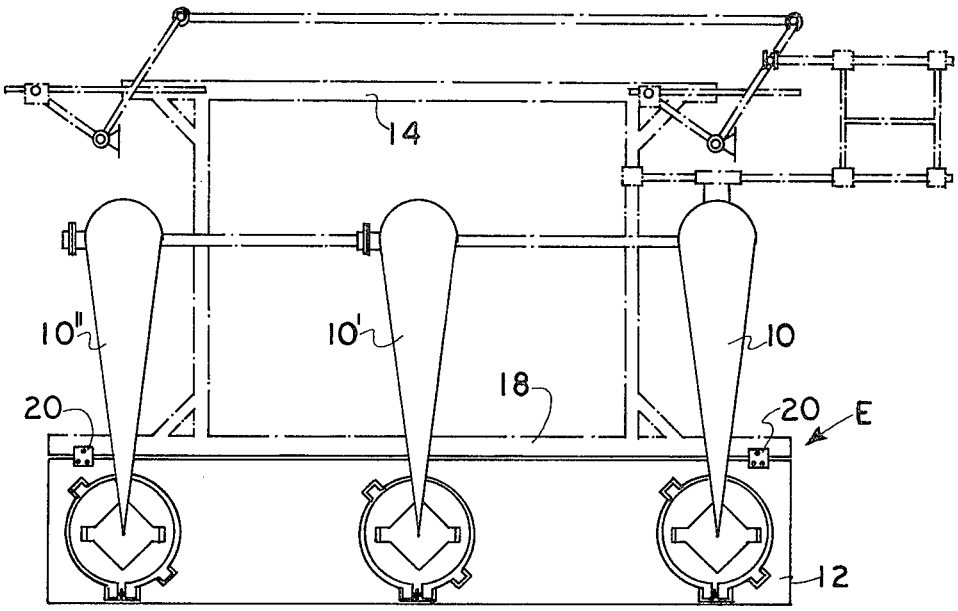
FIG. 1 is an environmental plan view illustrating an embroidery machine generally of the type with which the present invention is to be used.

Turning now to the drawings, and referring first of all to FIG. 1, there is illustrated a multiple head embroidery machine E of the type with which the present invention is utilized. Such machines E are conventional in design and do not need detailed explanation. It should suffice to mention that although the machine illustrated includes only three heads 10, 10', and 10'' there may be any number of heads, twelve heads being commonplace. The heads are each provided with an arm which carries at its forward end a vertically reciprocating needle, while the rear end of the head includes a leg (not shown) which secures the head to some type of base frame. The heads are coupled together so that a single drive mechanism causes all of the heads to operate in a well-known arrangement.

Further, in order to effect an embroidered pattern on the work pieces, a frame or fixture 12 is positioned beneath the row of heads, and is connected to some type of mechanical linkage or frame displacing device 14 which is operatively associated therewith for moving the frame 12, synchronously beneath the different heads. Fixture 12 includes a plurality of cutouts 16 therein, each being aligned beneath one of the heads and providing communication between the needle and needle plate thereof. With the exception of fixture 14 the aforementioned structure is conventional in substantially all multi-head embroidery machines. The present invention, to the contrary, is directed to the fixture 12 and associated inner rings 40 which support the small fabric work pieces such as pockets, collars, flaps, and the like.

Figure 2:
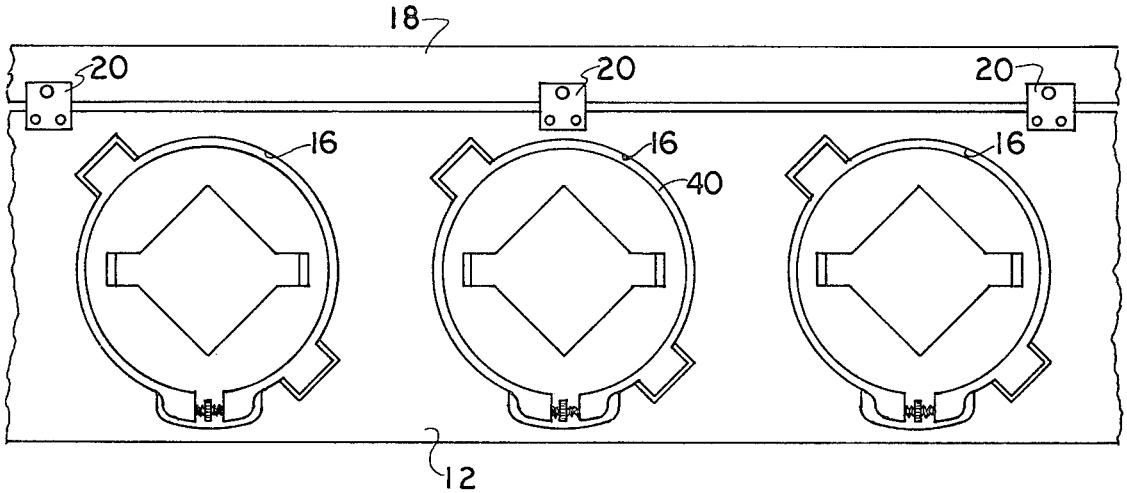
FIG. 2 is an enlarged plan view illustrating a portion of the embroidery fixtures with inner rings emplaced according to the present invention.

Turning now to FIG. 2, there is illustrated a portion of fixture 12 according to the present invention. The fixture is conventionally affixed to the front rail 18 of the frame displacing linkage 14 by means of connector plates 20. Thus, as the linkage 14 moves according to a prescribed program the fixture 12 is caused to move beneath embroidery heads.

Figure 5:
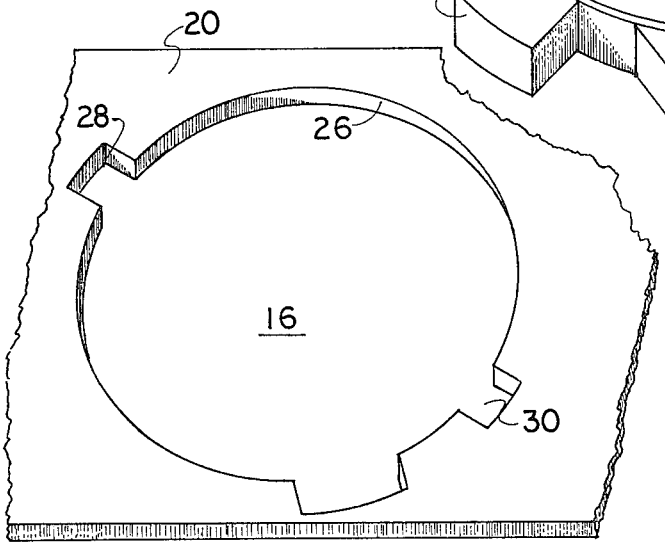
FIG. 5 is a partial perspective view of the fixture alone with the inner ring removed.

This is the conventional manner in which any fabric holding device is manipulated beneath the embroidery head in an automatic multi-head embroidery machine. Conventionally however, a female receiving device in the form of an outer hoop is secured beneath each head. Fabric to be embroidered is then positioned between the outer hoop and an inner releasable hoop, much in the manner as a conventional manual embroidery hoop arrangement. In the present invention, however, fixture 12 (see FIG. 5) is a relatively flat, planar member having a large opening 16 in the central portion thereof and a rim 26 into which a removable male inner ring 40 is laid.

Figure 3:
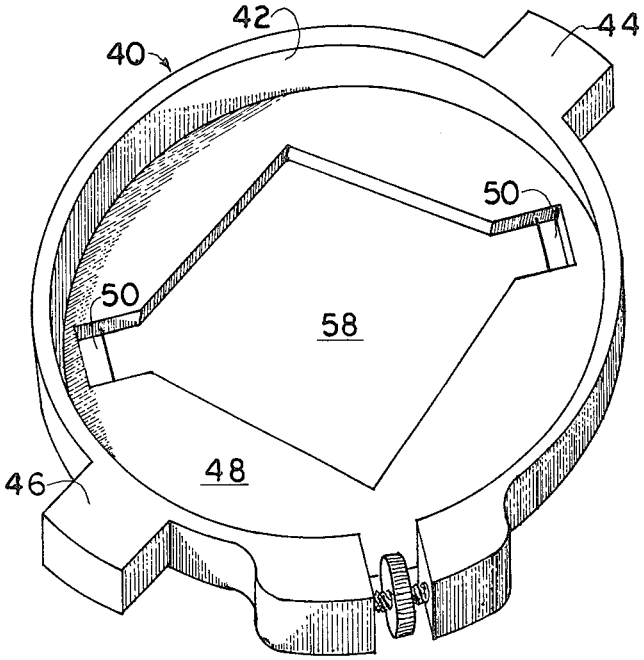
FIG. 3 is a top perspective view of an inner ring according to the present invention.

The use of the fixture 12 and the quick releasable male ring members 40, along with the construction of the ring members 40 form the heart of the present invention. Toward this end, looking at FIGS. 3 and 4, there is illustrated, in a preferred embodiment, the male ring member 40 which includes an upstanding outer wall 42 having a pair of positioning bosses 44,46 protruding outwardly from the periphery thereof. These bosses 44,46 are important in that when the hoop 40 is emplaced in the seat 26 in the female receiving member 12, the bosses 44, 46 are received in a pair of recesses 28,30 and ensure proper registration of the hoop member 40. A flat, plate-like bottom wall 48 having a cut-out 50 therein is secured to the lower edge of the ringlike member 42. While the ring member 40 is shown as being circular, this is exemplary only, as it may take any shape. Also rather than having bosses 44,46 the shape of the member 40 and the corresponding opening of fixture 12 may be such that positioning bosses are not necessary. Further while the wall 42 and plate 48 are preferable, they might be integrally formed or even a flst plate alone might be used where its thickness would facilitate easy emplacement and removal in the fixture 12, and where engagement by the needles is not likely. While ring member 40 includes a third projection from the side thereof, this is not necessary, but is merely shown in that applicant is utilizing existing outer hoops.

Figure 4:
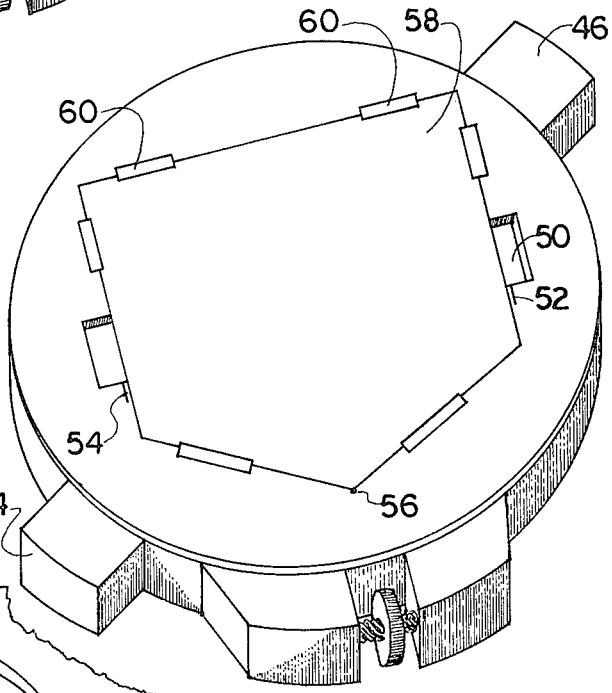
FIG. 4 is a bottom perspective view of the inner ring illustrated in FIG. 3.

When the male ring member 40 is turned over, as illustrated in FIG. 4, there may be inscribed indicia 52,54 and 56 on the rear surface thereof to properly locate or position the fabric piece 58 being attached thereto by adhesive or tape 60.

The plate member 48 is preferably formed of teflon, however, may be formed of any other flexible material having a durometer greater than 150. The reason for this requirement is that should a needle accidentally engage the plate member, it should be soft enough that it will penetrate it without breaking the needle. Where needle engagement is not likely, any material may suffice such as plywood.

A description of the operation of the multi-head embroidery machine E will quickly suggest that advantages of the present invention. First of all, such small fabric pieces as patch pockets, collars, flaps, and the like are not large enough to be held by the conventional hoop arrangement. Therefore the only known way to accomplish this before is to embroider on a larger piece of fabric, then cut the fabric to size. This results in tremendous waste of fabric. On the other hand, when the small articles are taped to the rear side of the adapter plate 48, it can be seen that even tiny fabric articles can be embroidered upon. Secondly, by using the male ring member 42 as a quick releasable fixture member, one set of fabric swatches can be embroidered, while a second set is being prepared by taping fabric swatches onto a second set of rings 40. Then when the embroidery operation is completed, the only machine down time necessary is to remove the hoops by lifting them out of the female receiving member 20 and inserting the new hoop members 40 therein. When emplaced, because of the bosses 44,46 being received in the cut-outs 28,30, the new fabric swatches are automatically properly positioned. As illustrated in FIG. 2, fixture 12 for all heads is integrally formed, but this may vary so that a single fixture 12 may serve one, two or any number of heads up to the entire complement.

Therefore, not only is there described herein an improved device for embroidering small fabric pieces, but also the operation time is considerably improved. While a preferred embodiment of the invention has been described in detail hereinabove, it is apparent that various modifications might be made without departing from the scope of the present invention which is set forth in the accompanying claims.

What is claimed is:

1. A small fabric piece holding device for embroidery machines of the type having a plurality of heads, each head carrying an embroidery needle; at least one fixture mounted beneath said plurality of heads; means for guiding said fixture according to a prescribed embroidery pattern, a fabric holding means associated with each head for positioning small fabric pieces to the embroidery needle; wherein said fabric holding means comprises at least one female receiving seat in said fixture and a quickly releasable inner male member loosely held in unsecured relation to said female receiving seat, and registration means between said female receiving seat and said male member for properly positioning each fabric piece.

2. The fabric holding device according to claim 1 wherein said male member comprises:

(a) a peripheral wall;

(b) a flat plate member secured to the undersurface of said peripheral wall, the periphery of said plate member being no greater than the periphery of said wall whereby there results no interference between the edge of said plate member and said female member when said male and female members are assembled;

(c) said registration means comprising at least one peripheral boss extending outwardly from said wall and a correspondingly shaped recess in said female receiving seat for receiving said boss when said male and female members are assembled together for proper registration thereof;

(d) quick release means for temporarily fastening a piece of fabric to the undersurface of said plate member; and (e) a cut-out in said plate member providing access for the needle of the corresponding head of said embroidery machine.

3. The fabric holding device according to claim 2 wherein said plate member is formed of a flexible material having a durometer of at least 150.

4. The fabric holding device according to claim 3 wherein said plate member is formed of teflon.

5. The fabric holding device according to claim 2 wherein said cut-out is diamond shaped and further having enlarged portions at opposite corners thereof whereby embroidering close to the edge of a piece of fabric is possible.

6. The fabric holding device according to claim 2 wherein said quick release means for temporarily fastening a piece of fabric comprises a plurality of adhesive strips.

* * * * *